US006655688B2

(12) United States Patent
Boateng

(10) Patent No.: US 6,655,688 B2
(45) Date of Patent: Dec. 2, 2003

(54) WORD GAME

(76) Inventor: Joseph O. Boateng, 72 School St., Cambridge, MA (US) 02139

( * ) Notice: Subject to any disclaimer, the term of this patent is extended or adjusted under 35 U.S.C. 154(b) by 0 days.

(21) Appl. No.: 10/196,529

(22) Filed: Jul. 15, 2002

(65) Prior Publication Data

US 2003/0020237 A1 Jan. 30, 2003

Related U.S. Application Data

(60) Provisional application No. 60/306,078, filed on Jul. 18, 2001.

(51) Int. Cl.[7] ..... A63F 3/00
(52) U.S. Cl. ..... 273/272; 273/146
(58) Field of Search ..... 273/272, 146, 273/299

(56) References Cited

U.S. PATENT DOCUMENTS

| | | | | | |
|---|---|---|---|---|---|
| 1,012,574 | A | * | 12/1911 | Adams | 273/299 |
| 3,606,336 | A | * | 9/1971 | Krause | 273/272 |
| 3,654,712 | A | * | 4/1972 | Bagdasar | 434/170 |
| 4,219,197 | A | * | 8/1980 | Acuff | 273/299 |
| 4,850,595 | A | * | 7/1989 | Sherman et al. | 273/240 |
| 4,944,519 | A | * | 7/1990 | Canela | 273/243 |
| 5,269,530 | A | * | 12/1993 | Miller | 273/243 |
| 5,417,432 | A | * | 5/1995 | Dwyer | 273/299 |
| 5,839,725 | A | * | 11/1998 | Conway | 273/244 |
| 5,863,043 | A | * | 1/1999 | Bitner | 273/299 |

* cited by examiner

*Primary Examiner*—William M. Pierce
(74) *Attorney, Agent, or Firm*—Weingarten, Schurgin, Gagnebin & Lebovici LLP

(57) ABSTRACT

A word game which is provided using a deck of cards and one or more dies. The cards comprise 26 alphabet cards each card containing a letter. A single die can be employed having a combination of numbers and right and left hand designations on each face thereof. In alternative embodiment, a pair of dice can be used, one containing numbers on respective faces and the other containing right and left designations on the die faces. The object of the word game is to think of words that contain the letter on the card, the letter being in the position within the word specified by the die. As an example if the card shows the letter A and the die shows 3R, the players must think of words in which A is the third letter from the right end of the word; for example, "state". In one scoring regime, one point is earned for each letter of the word. Thus in the above example the word "state" earns 5 points. A higher scoring word would be "invigorate" in which the letter A is in the third position from the right end, and, being a 10 letter word, earns 10 points. The game pieces can be housed in a multi-compartment box having a compartment for containing the cards, a separate compartment for pencils and one or more dies, and a portion of the box for containing score sheets and instructions. Scratch sheets or a scratch pad may also be included in the box. According to another aspect of the invention the game can be embodied as an electronic or computer game in which letters stored in memory are randomly presented upon user request and number position and left-right indication are also randomly presented upon user request.

9 Claims, 2 Drawing Sheets

WORD GAME

CROSS REFERENCE TO RELATED APPLICATIONS

This application claims priority under 35 U.S.C. §119(e) to Provisional Patent Application serial No. 60/306,078 filed on Jul. 18, 2001; the disclosure of which is hereby incorporated by reference.

STATEMENT REGARDING FEDERALLY SPONSORED RESEARCH OR DEVELOPMENT

N/A

BACKGROUND OF THE INVENTION

Various word games and puzzles are known. Some games employ cards containing letters or words, which are used to match up or select letters. Many games are of the crossword type in which letters are provided along rows, columns or diagonals to define words. Many word games also employ a playing board and some type of selection object such as dice or a spinning wheel. Many of the games are oriented toward play by children, while others are of a level of sophistication for play only by adults. It would be useful to provide a word game which can be played by a wide range of individuals having various linguistic abilities.

BRIEF SUMMARY OF THE INVENTION

The invention relates to a word game which is played using a deck of cards and one or more dies. The cards comprise 26 alphabet cards each card containing a letter. A single die can be employed having a combination of numbers and right and left hand designations on each face thereof. In alternative embodiment, a pair of dice can be used, one containing numbers on respective faces and the other containing right and left designations on the die faces. The object of the word game is to think of words that contain the letter on the card, the letter being in the position within the word specified by the die. As an example if the card shows the letter A and the die shows 3R, the players must think of words in which A is the third letter from the right end of the word; for example, "state". In one scoring regime, one point is earned for each letter of the word. Thus in the above example the word "state" earns 5 points. A higher scoring word would be "invigorate" in which the letter A is in the third position from the right end, and, being a 10 letter word, earns 10 points. As another example, if the die were to show 4L, and the card showed the letter A, a valid word would be "create" in which A is the fourth letter from the left end of the word. This word would earn 6 points. A longer word would be "creativity" which would earn 10 points.

The game pieces can be housed in a multi-compartment box having a compartment for containing the cards, a separate compartment for pencils and one or more dies, and a portion of the box for containing score sheets and instructions. Scratch sheets or a scratch pad may also be included in the box.

According to another aspect of the invention the game can be embodied in other forms. The game can be implemented as an electronic or computer game in which letters stored in memory are randomly presented upon user request and number position and left-right indication are also randomly presented upon user request.

BRIEF DESCRIPTION OF THE SEVERAL VIEWS OF THE DRAWING

The invention will be more fully described in the following detailed description in conjunction with the drawings in which.

DETAILED DESCRIPTION OF THE INVENTION

Figure 1:
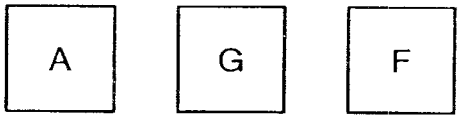
FIG. 1 is a plan view of cards containing letters and used in the invention.

The word game according to the invention is played in one preferred embodiment using a deck of cards each of which has a letter imprinted thereon. FIG. 1 shows 3 cards containing respectively the letters A, G and F. The cards cover the full 26 letter alphabet and typically have respective letters printed on one face thereof. The back faces of the cards can contain any intended design or logo or may be left blank as they form no part of the game. The letters may be printed in upper or lower case or in any size or type style to suit the visual and esthetic appeal of the game.

Figure 2:
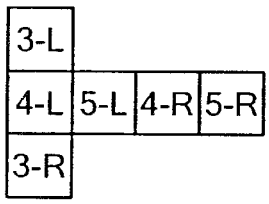
FIG. 2 is a diagrammatic view of the six faces of a six sided die containing the letter and direction indications in one embodiment of the invention.
Figure 3:
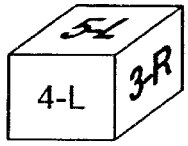
FIG. 3 is a pictorial view of a six sided die containing number and direction designations.

In the illustrated embodiment a single six sided die is employed as shown in FIG. 3 and having the number and direction designations as shown in FIG. 2. In the illustrated embodiment each face of the die contains a number 3, 4, or 5, and a direction L for left or R for right. The number represents the position of the letter shown on a card counted from the left or right of a word. Thus if a selected card contains the letter G and the die upper face contains the designation 4L, one or more words must be picked which have the letter G as the fourth letter from the left of the word or words.

The die may contain numbers other than those illustrated to denote other letter positions within a word. Different dies can be provided each having different number combinations suitable for different word lengths and degrees of difficulty. For example, one die can contain the number 3, 4, and 5, and another die can contain the numbers 4, 5, and 6. The number combinations can also be more or less than the three number combinations shown.

The right and left hand designations are denoted in the illustrated embodiment by the letters R and L. Other designations can be employed in alternative implementations. Two or more dies may also be used in alternative versions of the game. For example one die may contain the numbers representing the position of letters, and the other die can contain left and right direction designations.

The game challenges players to exercise their vocabularies and problem solving skills and can provide both educational and entertainment benefit.

The game is played in the following manner. Initially the players should agree upon the number of points required to win a game. One player shuffles the deck of cards and places the deck face down on a playing table. Each player takes a card from the deck. The player whose card comes first in the alphabet plays first, the player to the first player's left will play second and the play continues from player to player in similar manner. The players return the cards to the deck and the cards are again shuffled by the player who initially shuffled the cards. The first player turns the top card over and places it face up next to the deck and that player rolls the die. All of the players immediately try to think of words that meet the conditions specified by the card/die combination, and each player tries to be the first to call out a valid word. The player who first calls out a valid word presents the word to the others. If the word is accepted, the player is awarded a number of points equal to the number of letters in the accepted word. If no player can think of a word, then any player can initiate a move to pass. If at least one other player also moves to pass, the current player draws another card and rolls the die again. The play continues in similar fashion until there is a winner achieving the predetermined number of points required to win a game.

Figure 5:
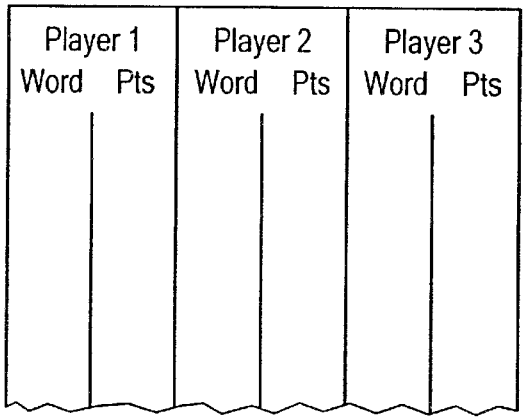
FIG. 5 is a plan view of a score sheet used with the novel word game.

Each player's score is kept on a score sheet such as shown in FIG. 5. The score sheet contains a column for each player and in each column there is a space for entering the selected words and the points for each of those words. The score sheet also has a space to indicate the number of points required to win the game.

Various rules and limitations can be provided to vary the challenge and skill level of the game. For example, a rule can provide that the letter in play cannot be the first or last letter in the player's word even if it meets the letter/die combination. For example, "ate" would not be a valid word even though it fulfills the A and 3R conditions. Another example would be the word "tea" which would not be a valid word for A and 3L conditions. Another rule could be that if a player makes a mistake, for example by calling out an unintended or incorrect word, the card in play is retired for the remainder of the game and the player who calls out an unintended or incorrect word loses points equal to the number of letters in the wrong word.

If all cards have been used and no player has earned the winning number of points, the next player reshuffles the deck and the play continues.

Other word limitations can typically be that a word cannot be used more than once in any game, and that proper names, abbreviations and words requiring a hyphen or an apostrophe are not acceptable.

Score keeping can be enhanced in various ways. For example, when a player's cumulative score has 0 as its last digit such as 20, 30, etc., he or she automatically gains an additional 5 points. For example, a score of 20 is raised to become 25.

The rules can also provide for challenge of a word and the challenge can result in a transfer of points between the applicable players. A player who wishes to challenge another player's word can state "I challenge". If the challenger is correct and the word challenged is not acceptable, the challenged player loses points equal to the number of letters in the challenged word. The challenger can gain points equal to the number of letters in the challenged word. If the challenge is not valid, in that the challenged word is in fact an acceptable word, the player making the challenge loses points equal to the number of letters in the challenged word.

It is recognized that the game rules and details of play can vary to suit the age level, skill and sophistication of the intended game players.

Figure 4:
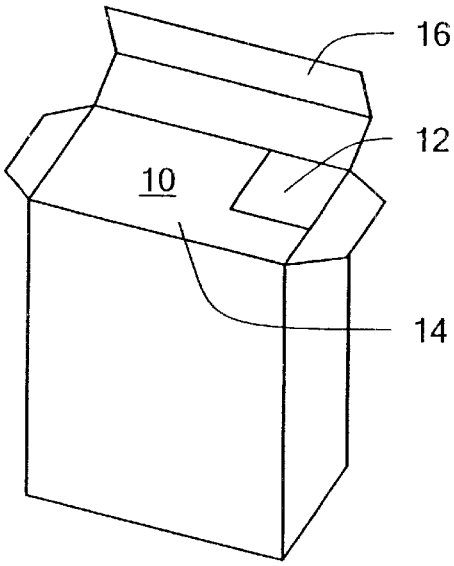
FIG. 4 is a pictorial view of a multi-compartment box for containing the pieces of the game.

The game pieces are preferably housed in a multi-compartment box as shown in FIG. 4. The box has a compartment 10 for containing the deck of cards, a smaller compartment 12 for containing scoring pencils and one or more dies. The compartment 12 does not extend across the full depth of the box and provide a full width space 14 for containing folded instructions and score sheets. The box is closed with side and top flaps 16.

The cards and one or more dies can be of any convenient size. Typically the cards are the size of a conventional deck of playing cards and the die is about ¾ inches square. The cards can be made of cardboard or any other suitable material which can contain the letters thereon. The die is typically of a plastic material with the letters and direction designations printed or otherwise applied or formed in each face.

Figure 6:
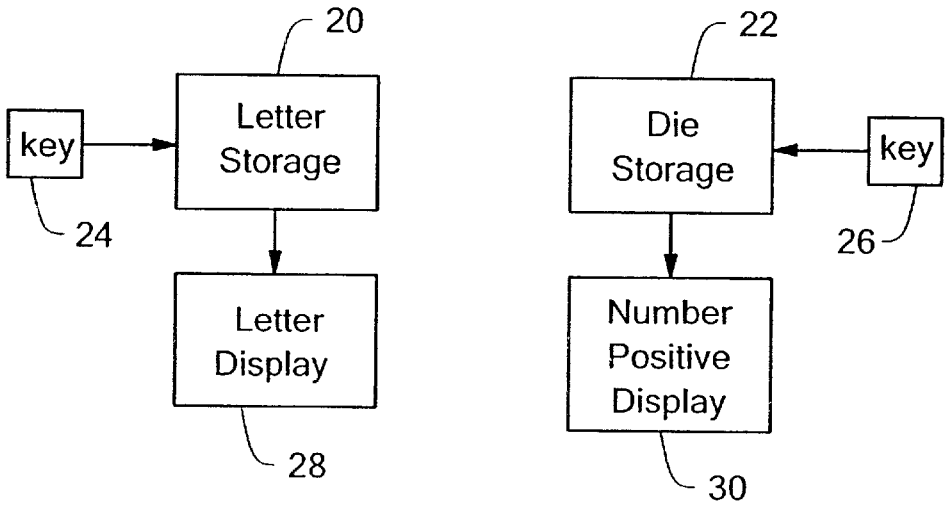
FIG. 6 is a block diagram of an electronic or computer game system embodying the invention.

The game can also be implemented in electronic or computer form. The game can be implemented as a computer game embodied in software and usable with a conventional laptop or personal computer. Alternatively the game may be embodied in and playable on a handheld device such as a Palm type device. The game may also be embodied in a special purpose game package having keys and a display or in a game package which can be plugged into a television set or computer to use the screen as a game display. Referring to FIG. 6 there is shown in block diagram form a computer or electronic system having a memory storage 20 containing the letters of the alphabet, a memory storage 22 containing number and direction designations, a control key 24 coupled to memory 20, and a control key 26 coupled to memory 22. The memory 20 is in communication with a letter display 28 and the memory 22 is in communication with a number-direction display 30.

In operation a user presses key 24 to cause the random selection of a letter stored in memory 20 and the display of that letter on display 28. The user then presses key 26 to cause the random selection of a number and position for display on display 30. The game can be played as in the manner described above to identify words meeting the displayed criteria.

Figure 7:
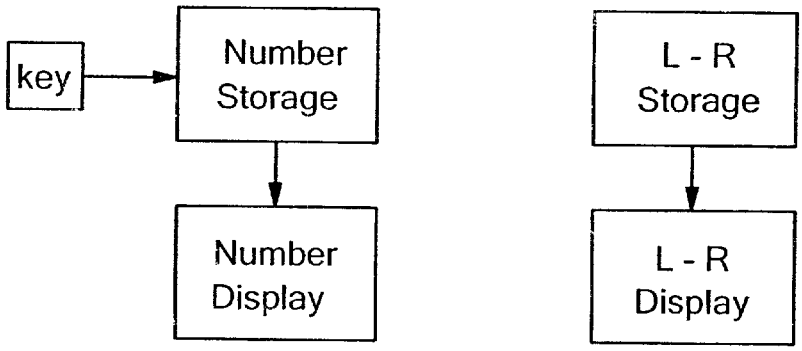
FIG. 7 is a block diagram of an alternative embodiment of the electronic or computer game of FIG. 6.

In an alternative implementation, a separate memory can be provided for storage of the letter position and for the left-right designation. A user actuates the respective keys to cause random selection of a number for display and the random selection of the left or right designation for display on the respective displays, as shown in FIG. 7.

A dictionary of words can also be stored in memory and which can be chosen by a player based on the selected criteria. The scores of the players may also be tallied and stored in memory for display at the end or during a game.

It is contemplated that the displays can present the letters and number and direction indications in many different ways. The display screen may be initially blank with the display indications provided upon user's actuation of control keys. Alternatively, the display may present a scrolling sequence of letters, numbers and direction designations with the display being stopped when the user hits the control keys. A single screen may be employed to display all relevant information in respective locations.

In a further embodiment using a deck of cards, the cards can be automatically shuffled in a shuffling mechanism. The mechanism is operative each time the user hits a control key to dispense a single card for display of a selected letter.

The invention is not to be limited by what has been particularly shown and described and is intended to embrace the full spirit and scope of the appended claims.

What is claimed is:

1. A word game comprising:

a deck of cards each card containing a letter on a face thereof;

a multi-faced die each face thereof having a number and a right or left hand designation;

the number representing the position of the letter on a selected card in a word, and the direction designation denoting the left or right end of the word from which the position is counted.

2. The word game of claim 1 wherein the deck of cards is a 26 card deck each card containing a respective letter of the alphabet.

3. The word game of claim 1 wherein the die is a six sided die.

4. The word game of claim 3 wherein the direction designations are the letters L and R.

5. The word game of claim 1 further including a box having a first compartment for containing the deck of cards, a second compartment for containing the die and scoring pencils, and a space for containing folded directions and scoring sheets.

6. A word game comprising:

media storing the letters of the alphabet;

a second media storing numbers representing letter positions in words and right and left hand designations;

a selector for selecting a single letter and selecting a number and a right or left hand designation for display to the user; and the number representing the position of the selected letter in a word, and the direction designation denoting the left or right end of the word from which the position is counted.

7. The word game of claim 6 wherein the media is an electronic storage media.

8. The word game of claim 6 wherein the media is a deck of cards, each card containing a letter on a face thereof.

9. A word game comprising:

first data storage memory containing the letters of the alphabet;

a second data storage memory containing word position numbers and right and left hand designations;

a first control operative to randomly select a letter in the first storage memory;

a second control operative to randomly select a number and right or left hand designation from the second storage memory;

a display for showing the selected letter, number and right or left hand designation; and the number representing the position of the selected letter, and the direction designation denoting the left or right end of the word from which the position is counted.

* * * * *